United States Patent [19]

Degrauwe et al.

[11] Patent Number: 4,647,482

[45] Date of Patent: Mar. 3, 1987

[54] METHOD AND APPARATUS FOR CURTAIN COATING

[75] Inventors: Dirk M. Degrauwe, St. Niklaas; Eduard A. Geleyns, Louvain, both of Belgium

[73] Assignee: Agfa-Gevaert N.V., Mortsel, Belgium

[21] Appl. No.: 777,763

[22] Filed: Sep. 19, 1985

[30] Foreign Application Priority Data

Oct. 5, 1984 [EP] European Pat. Off. ... EP84201427.6

[51] Int. Cl.[4] ..... B05D 1/30

[52] U.S. Cl. ..... 427/420; 118/44; 118/300; 118/DIG. 4

[58] Field of Search ..... 118/300, DIG. 4, 44; 427/420

[56] References Cited

U.S. PATENT DOCUMENTS

| | | | |
|---|---|---|---|
| 3,359,941 | 12/1967 | Sible | 118/DIG. 4 |
| 4,479,987 | 10/1984 | Koepke et al. | 427/420 |
| 4,559,896 | 12/1985 | Bossard et al. | 118/DIG. 4 |

FOREIGN PATENT DOCUMENTS

| | | | |
|---|---|---|---|
| 1099127 | 1/1968 | United Kingdom | 118/DIG. 4 |
| 2103961 | 3/1983 | United Kingdom | 427/420 |

*Primary Examiner*—Shrive P. Beck

*Attorney, Agent, or Firm*—William J. Daniel

[57] ABSTRACT

Method and apparatus for curtain coating a flexible web by coating the curtain at a width wider than the width of the web. The margins of the web are preserved from being coated by conveying the web in the coating zone over a web supporting roller than does not support the web margins, and by deflecting the unsupported web margins downwardly by means of curtain interceptors that remain in contact with the web under the elastic recovery forces in the web material.

13 Claims, 6 Drawing Figures

METHOD AND APPARATUS FOR CURTAIN COATING

Figure 1:
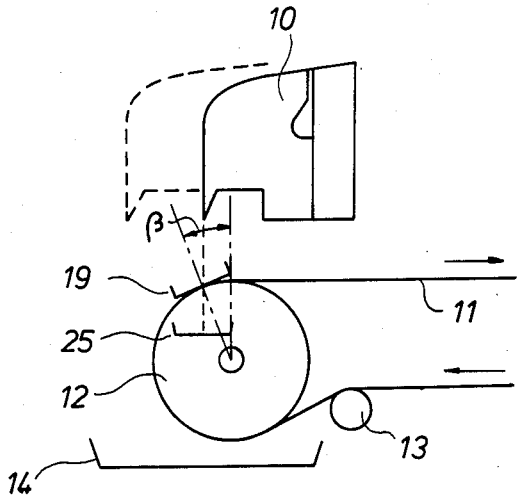

The present invention relates to a method and apparatus for coating a web with at least one layer of coating composition, by means of curtain coating. The method and the apparatus are particularly useful for the production of photographic material.

In curtain coating, a travelling web is coated by a free-falling curtain of coating liquid that is caused to impinge onto the travelling web to form a layer thereon. The width of the free falling curtain can be maintained by edge guides that are in adherent, i.e., wetting, contact with the lateral boundaries or edges of the curtain. In the absence of edge guides, the tendency towards a lower state of energy would cause the curtain to neck in appreciably, or to split up into a number of strands. The wetting contact of the edges of the curtain with the guides causes non-uniformities in the coating if the full width of the curtain is applied to the moving web. By making the curtain wider than the web to be coated by an amount at least equal to this non-uniform region at each edge, a substantially uniform coating can be formed on the web itself. The coating liquid at the margins of the curtain that overflows the edges of the travelling web can be collected and recirculated to the coating liquid supply.

When the coating is formed up to the edges of the web, there is a serious risk of the coating wetting those edges and also running onto the reverse side of the the web before the coating has gelled. This can cause a soiling of the web transporting rollers of the web gelling and drying stations in consequence of which the production process must be interrupted to clean the rollers.

Another disadvantage of coating the web up to its side edges is due to the fact that the coated web margins are often trimmed off in the production process. The margins of webs, in the case of plastic webs such as triacetate, PET, and others, are usually knurled in order to improve the stability of wound rolls of coated web and also to reduce the winding pressure on the part of the web between the knurled margins. When a coated web is being slit into narrower bands, these knurled margins are discarded and this means a loss of coating composition. It is thus often highly desirable to coat a web in such a way that uncoated web margins are preserved. A known technique for achieving this purpose uses curtain interceptors, e.g. in the form of catch trays, disposed between the coating hopper and the web, for intercepting marginal zones of the curtain, that would otherwise fall on the web margins which are required to be left uncoated.

This use of interceptors is disclosed in U.S. Pat. No. 3,359,941 in association with a curtain coater intended particularly for coating fiberboard sheets. The method described therein has the disadvantage that the reduced width curtain flowing past the interceptors has free edges so that surface tension causes the curtain to start to neck-in and to acquire beaded edges. These beaded edges are deposited on the web and they increase the drying load at the marginal zones of the web whereby a longer time is required to dry these zones than to dry the central web areas.

The curtain coater described in this U.S. Patent is intended for coating fairly stiff sheets and the coating station is located between spaced endless band conveyors so that the curtain of coating material falls onto the sheets as they move across the gap between the conveyors. This arrangement is not satisfactory for coating thin flexible sheet material with a high degree of precision in the thickness and uniformity of the coating, e.g. for coating polymeric film serving as the film base of photographic material.

In curtain coaters for such precision work, the material to be coated is positively supported over its full width by a supporting roller at the actual zone of impingement of the descending curtain of coating composition. If curtain edge interceptors were introduced into such curtain coaters between the supporting roller and the edge margins of the descending curtain the undesired beading of the curtain beneath the interceptors might be avoided if the interceptors were mounted actually in contact with the material being coated. However this positioning of the interceptors would be extremely difficult when coating delicate materials which must not suffer any surface damage, e.g. when coating polymeric film to form light-sensitive photographic material. The positioning of the interceptors would in those circumstances be critical because the slightest scratching or scraping effect caused by too much contact pressure between the interceptors and the material being coated would damage the product and even make it worthless. On the other hand the existence of a gap between each material and the interceptors would result in some beading effect at the coating edges as above referred to.

It is an object of the present invention to provide a curtain coating process and apparatus by which uniform coatings can be formed on a substrate while leaving marginal portions of the substrate uncoated, and which is suitable for precision and delicate work.

According to the present invention there is provided a method of curtain coating a flexible web, which method comprises conveying the web over a web-supporting roller; forming a free-falling curtain of coating composition of a width greater than that of the web, said width being maintained by side edge guides in wetting contact with the curtain edges, and the curtain being so positioned that its central part falls on a region of the web which is supported by said web-supporting roller while the opposed side edges of the curtain extend externally of the opposed side boundaries of the web; and intercepting and collecting edge portions of the curtain which would otherwise impinge on margins of the web thereby to preserve those margins in uncoated condition, characterised in that the web-supporting roller has a length less than the width of the web and leaves opposite marginal portions of the web unsupported, and the said interception occurs at least proximate to the plane of the supported region of the film while the marginal portions of the web are slightly downwardly deflected below such plane against elastic recovery forces thereby induced in the web.

The term "web" as used in the foregoing description of the invention denotes a length of sheet material.

In a method according to the present invention direct contact of the intercepting means with the web is permissible even if the web material is a delicate material, such as a photographic film base material, because the material is not positively supported at the thus contacted zone and the contact pressure is merely that attributable to the elastic recovery forces stored in the material in consequence of its deflection from the film plane. A very slight deflection suffices to ensure that contact is maintained.

The web can be guided along a path running tangentially past the web-supporting roller, in which case the vertical path of the curtain of coating composition will be in line with the axis of such roller.

However, it is preferable for the web to be conveyed around the web-supporting roller so as to be supported thereby over an arc of movement. And for high precision work it is much preferred to combine this arrangement with positioning of the coating curtain so that its vertical path is chordal to such roller and intersects the roller at a zone within a part of the web path which is curved around such roller.

In a preferred embodiment of the method according to the invention, the interceptors are mounted in a tilted position so that the intercepted liquid is drained off under the force of gravity.

The method according to the invention can be used for the application of a single layer of coating composition to a web, as well as for the application of a plurality of superposed layers to a web. In the case of the coating of a plurality of layers, the method according to the present invention can be combined with the method according to U.S. Pat. No. 4,233,346 entitled "Method and apparatus for applying a plurality of superposed layers to a web by curtain coating". The latter method achieves a reduction in the losses of coating composition that occur as a consequence of the intermixing of portions of the coating layers that are not applied on the web.

The invention includes also an apparatus for the coating of a layer or layers onto a web.

According to this aspect of the invention, there is provided a curtain coater for coating a flexible web, which coater comprises means for conveying a web along a predetermined path through a coating station, said conveying means including a web-supporting roller at that station which has a length less than the web to leave the web margins unsupported; means for forming at said coating station a falling curtain of coating composition of a width exceeding the length of said roller and at a position such that it will fall onto the web at a zone where it is supported by said roller; side edge guides for contact by the side edges of a said curtain thereby to restrain the curtain from necking-in; deflecting against the elastic forces in the web the unsupported margins of the web doenwardly below the general plane of the web and for intercepting portions of said curtain descending towards margins of said web and directing such portions away from the web, said interception of coating composition occurring at least in proximity to the general plane of the web.

Figure 6:
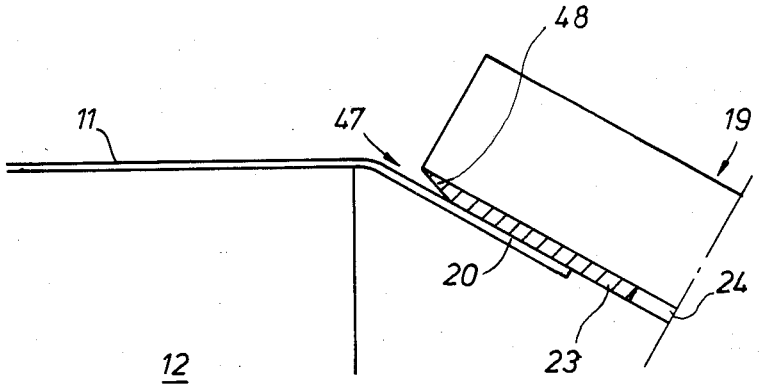
Figure 2:
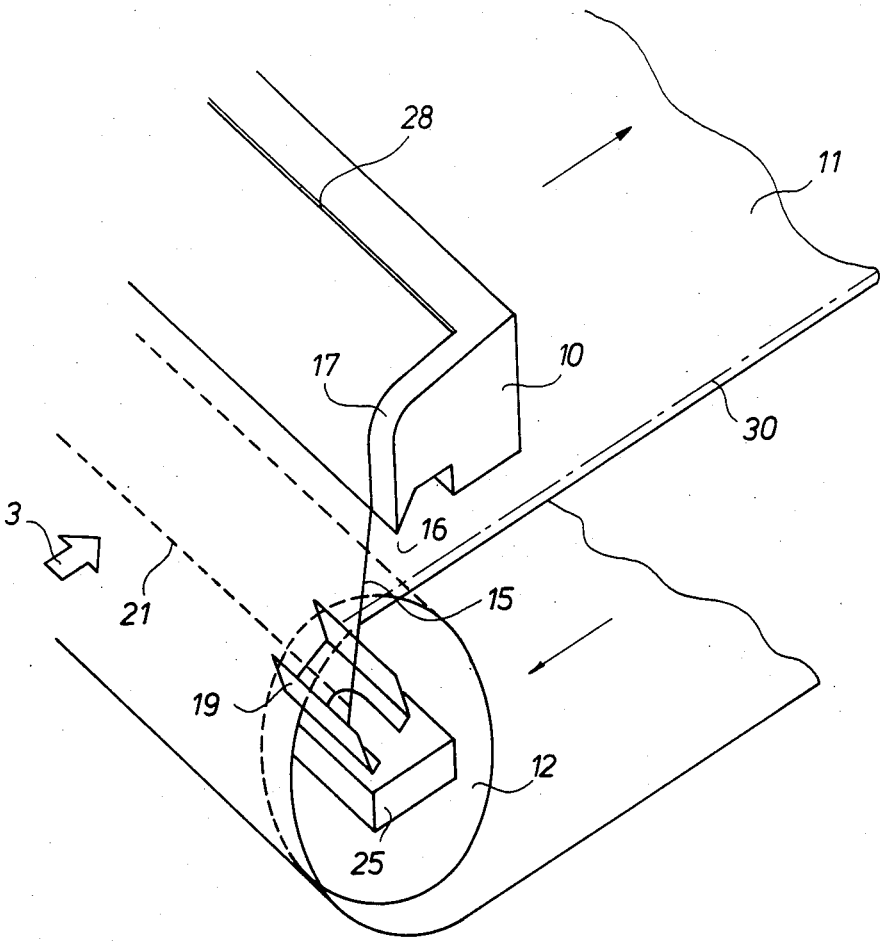
Figure 3:
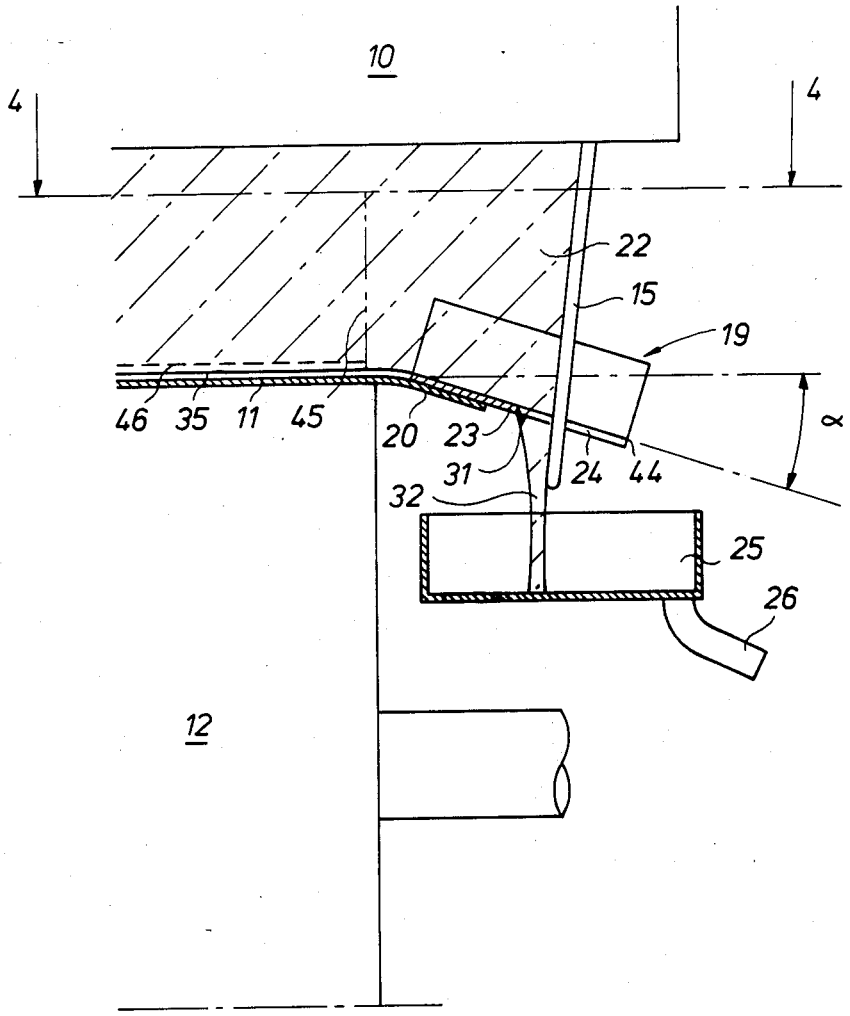
Figure 4:
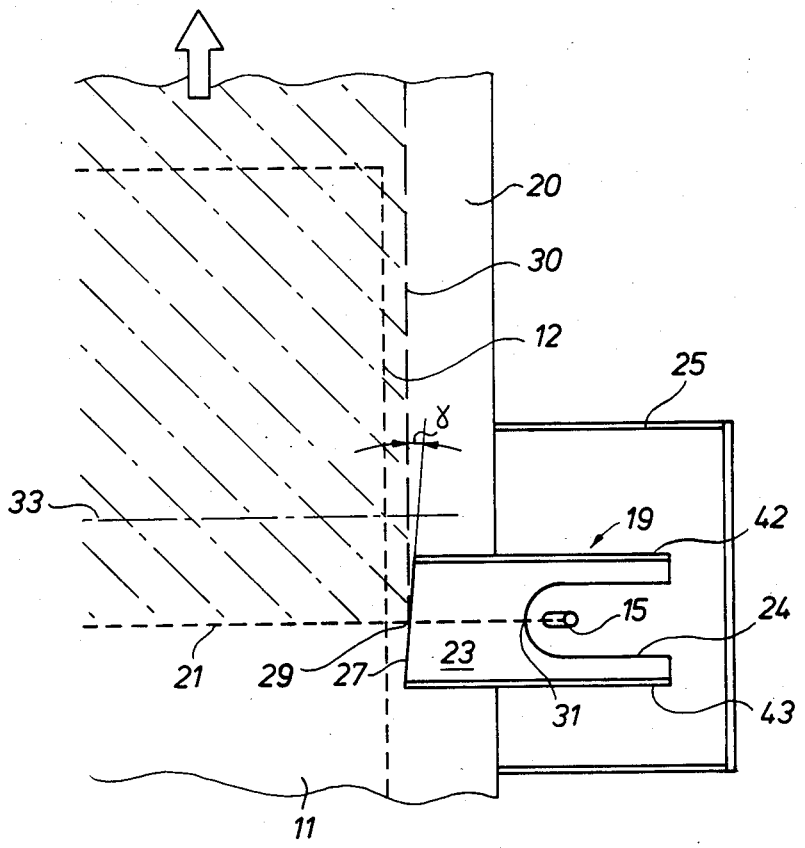
Figure 5:
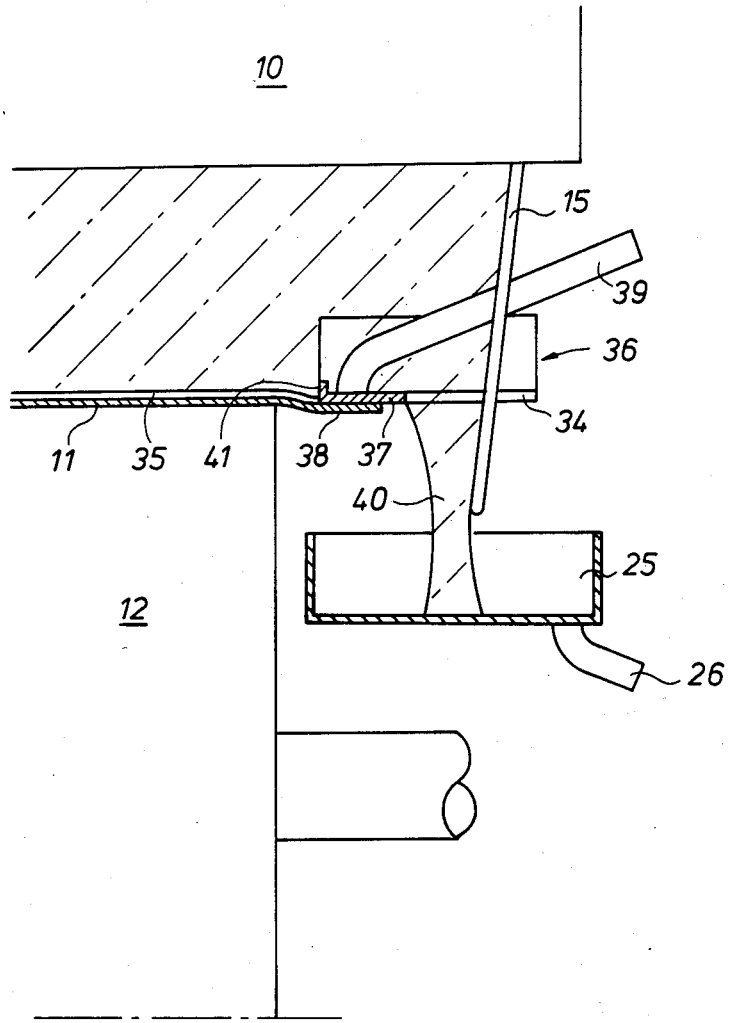

An embodiment of the invention will be described hereinafter by way of example with reference to the accompanyimg drawings, wherein:

FIG. 1 is a diagrammatic representation of one embodiment of a curtain coater according to the invention, FIG. 2 is a perspective view of the coater according to FIG. 1, FIG. 3 is a front elevation of the coater according to the arrow 3 of FIG. 2, FIG. 4 is a horizontal sectional view on line 4—4 of FIG. 3, FIG. 5 is a front elevation of another embodiment of a coater according to the invention, and FIG. 6 is a detail of FIG. 3, illustrating a modified embodiment of the curtain interceptor.

Referring to FIG. 1, a coating head 10 of the slide-hopper type is arranged for applying a layer of liquid coating composition on a moving web 11 by curtain coating. The web is moved through the coating zone along a path that is determined by a web-supporting roller 12 to which the web is advanced over a guide roller 13. The web has a width that exceeds the length of the roller 12, and is steered by means, not shown, so that its opposite margins project to approximately the same extent beyond the ends of the roller. The coating head can be arranged for movement from an inoperative position, shown in broken lines, into an operative position shown in solid lines. In the inoperative position, the deaeration of the coating head and its related supply circuit, and the starting of the formation of the curtain can occur. The coating composition that flows downwardly during this step of the coating procedure is collected in a pan 14.

When the coating is in stable downward flow, the coating head can be moved by suitable means into the operative position. In that position the curtain flows down onto the web at a position that is preferably situated in the upper left-hand quadrant of the web-supporting roller 12. During the free fall of the curtain its edges are kept in adherent contact with the stationary guides. One curtain guide, denoted 15, appears in FIG. 2. The guide may be in the form of a rod or the like, fixed to the edge 16 of the slide surface 17 of the hopper 10. The guide preferably extends downwardly past the path of the web in the coating zone.

The interception of the marginal portions of the curtain in order to preserve the web margins from being coated is illustrated in detail in FIGS. 3 and 4 for one web margin.

A curtain interceptor 19 consisting of a rectangular piece of sheet metal folded in such a way that it forms a U-shaped element with sidewalls 42 and 43 and a bottom wall 23, held (by means which is not illustrated) at a slight inclination way so that it slightly downwardly deflects the margin 20 of the web 11 that projects from the end of the web-supporting roller 12. The mounting of the interceptor is such that it can be easily swung away for cleaning purposes, or for wrapping a fresh web about the roller. The angle of inclination of the interceptor is indicated by $\alpha$. The position of the interceptor is preferably further such that the interceptor contacts the projecting unsupported web margin over at least the outer half of the width of the margins. In this way a good control of the position of the margins is obtained. In the case of a more limited contact, it may occur that, depending on the elasticity of the web margins and on occasional variations thereof (consider for instance web splices), a satisfactory contact between interceptor and web is not obtained. The angular position of the longitudinal axis of the interceptor about the axis of the roller is equal to that of the line of intersection 21 of the curtain 22 with the surface of the web-supporting roller 12. This angular position is indicated by the angle $\beta$ in FIG. 1. The cross-sections through the web, the interceptor and the catch tray have been shown as occurring at right angles in the drawing of FIG. 3, thereby to simplify the drawing.

The bottom wall 23 of the interceptor 19 is provided with a slotlike opening 24 through which the curtain guide 15 extends freely. The innerside edge 27 (see FIG. 4) of the bottom wall 23 of the interceptor diverges with respect to the direction of motion of the web. The angle of divergence has been indicated by $\gamma$ in FIG. 4.

Below each interceptor and spaced therefrom and also spaced from the curtain guides, there is provided a catch tray, such as the tray 25 illustrated in FIGS. 3 and 4, with a conduit 26 for carrying off the collected coating composition.

In operation of the coater, a layer of coating compositon is formed through the slotlike opening 28 of the coater 10, see FIG. 2, and this layer flows downwardly over the slide surface 17 until at the edge 16 a free-falling curtain of coating composition is formed. The guides 15 keep the curtain stretched, and the curtain impinges on the web at a position indicated by the broken line 21. The coating forms a layer on the web indicated by 35 in FIG. 3. The marginal portion of the curtain that extends outwardly of point 29 (see FIG. 4), which is the intersection point of the line of impingement 21 with the edge 27, is intercepted by the interceptor 19 so that the coating width on the web is limited as indicated by the dash-and-dot line 30, the hatched area representing the coated web portion. The interception of the curtain portion extending outside of point 29 is not complete, since an outermost part thereof freely descends between the curtain guide 15 and the innermost point 31 of the opening in the bottom wall 23 of the interceptor, see FIG. 3. The liquid mass 32 (FIG. 3) comprises the unintercepted liquid just described, as well as the liquid that has been intercepted by the interceptor 19. The liquid is caught by the catch tray 25 and can be conducted therefrom to the supply of coating composition, that is used for the feeding of the hopper.

The impingement of the curtain on the web occurs in this embodiment in the upper left quadrant of the web-supporting roller, and the angle $\beta$ indicates the angle between a radius through the point of impingement and a vertical plane.

In the described embodiment, the inner edge 27 of the interceptor is, as already stated, divergent with respect to the direction of motion of the web. The angle of divergence is the angle $\gamma$ in FIG. 4 (the opposite interceptor correspondingly diverges from such direction of motion). It has been found that this divergency is particularly favourable for obtaining a rectilinear and unbeaded edge of the coated layer on the web. This does not exclude, however, that an edge at an angle of zero degrees can also give good results, provided the positioning of the interceptor is so accurate that the angle certainly does not become negative, i.e. converging, and provided that the edge 27 is precisely straight.

The evacuation of the intercepted coating liquid from the interceptor has been illustrated as occurring by gravity. It should be noted that the evacuation may also occur by sucking-off the liquid. In the latter case the interceptor may even be positioned in an untilted position, and such arrangement is illustrated diagrammatically in FIG. 5, wherein an interceptor 36, that can have generally the same form as the interceptor 19 illustrated in FIG. 3 but that has an additional upstanding wall 41 of limited height, e.g. between 1 and 3 mm, is arranged is such a way that its bottom wall 37 runs horizontally and slightly downwardly displaces the free projecting web margin 38 as illustrated in the Figure. Coating liquid that is intercepted by said bottom wall 37 is continuously removed by a suction pipe 39 the lower end of which is closely spaced from the upper surface of said wall 37. Coating composition that extends between the opening 34 of the interceptor and the edge guide 15, is received as a strand of liquid 40 in a catch tray 25 as described hereinbefore.

In the coaters described so far, the bottom wall 23 of the interceptors 19 and 36 is flat. It will be understood that the interceptor may have other forms, e.g. with a bottom wall that is slightly bent about the longitudinal axis of the interceptor, in order to follow the curvature of the web.

The inteceptor need not necessarily be provided with a slotlike opening like 24, 34 in its bottom wall, since the curtain guide 15 may also terminate just above said bottom wall. In this case the intercepted coating liquid will be carried off at the outer end of the interceptor, i.e. the end 44 in FIG. 3.

The following are examples of methods and apparatus according to the invention.

EXAMPLE 1

The coater illustrated in FIGS. 1 to 4 was used for the coating of a single layer on a polyethylene terephthalate web that was provided with a subbing layer. The following data illustrate the coater:

length of the slot 28: 340 mm
height of the curtain: 70 mm
length of roller 12: 200 mm
diameter of roller 12: 200 mm
width of web 11: 240 mm
interceptor 19 made from steel sheet with a thickness of: 0.5 mm
tilting angle $\alpha$ of interceptor: 17 degrees
coating angle $\beta$: 10 degrees
angle of divergence $\gamma$: 5 degrees
width of margin 20: 10 mm
rate of flow: 147 $mls^{-1}m^{-1}$
speed of web: 220 $mmin^{-1}$ The coating composition was an aqueous silver halide dispersion as used in the manufacturing of photographic film for graphic purposes, with a solid contents of 140 g/l and a viscosity of 10 mPa.s at 36° C. The static surface tension of the composition was measured by means of a Wilhelmy plate and amounted to 30 mN/m. A photomicrograph of a cross section of the dried web showed that bead formation at the edges of the coated layer was less than 15% of the thickness of the layer, and that the margins 20 of the web were completely free from the coated layer, except for the subbing layer that covered the complete width of the web.

EXAMPLE 2

The coater illustrated in FIGS. 1 to 4 was used, the coating hopper being replaced, however, with a hopper that comprised two parallel spaced coating slots for the production of a curtain consisting of two superimposed layers.

The upper located coating slot of the hopper had a length that slightly exceeded than the length of the lower located slot. In the mentioned way, a composite curtain was obtained with the edges of one layer only being in contact with the curtain guides.

In this way, the method according to U.S. Pat. No. 4,233,346 mentioned already in the introduction of this specification could be performed, whereby intermixing of the coating liquid that is recirculated to the coating hopper is avoided. Referring to FIG. 3, the wider layer of the composite curtain is represented by the hatched area, whereas the narrower layer of the curtain ends at the place indicated by the dash and dot line 45, forming in this way a coating 46 indicated in broken lines, on the web 11. The only critical point in the application of the method of the mentioned U.S. Patent, is that the narrower layer remains well remote from the interceptor 19 so that the coating liquid that is caught in the tray 25 is only the liquid of the wider layer, and may be recirculated in that way to the liquid supply of the upper coating slot.

The following data illustrate the coater:

length of the upper coating slot: 200 mm
length of the lower coating slot: 340 mm
height of the curtain: 70 mm
length of roller 12: 200 mm
diameter of roller 12: 200 mm
width of the web 11: 240 mm
interceptor 19 made from steel sheet with a thickness of: 0.5 mm
tilting angle $\alpha$ of interceptor: 17 degrees
distance between points 29 of opposite interceptors: 210 mm
width of smaller curtain layer upon impingment on the web: 200 mm
width of wider curtain upon impingment on the web: 210 mm
coating angle $\beta$: 15 degrees
angle of divergence $\gamma$: 5 degrees
width of uncoated web margin 20: 15 mm
rata of flow of wider layer: 86 ml $s^{-1}m^{-1}$
rata of flow of narrower layer: 50 ml $s^{-1}m^{-1}$ The coating composition of the wider layer was an aqueous silver halide dispersion, with a solid contents of 120 g/l and a viscosity of 15 mPa.s at 36° C. The static surface tension of the composition was measured by means of a Wilhelmy plate and amounted to 33 mN/m.

The coating composition of the narrower layer was an antistress mixture with a solid contents of 40 g/l and a viscosity of 5 mPa.s at 36° C. The static surface tension of the composition was measured by means of a Wilhelmy plate and amounted to 35 mN/m.

The dried layers on the web had a width of respectively 210 and 200 mm, and bead formation of the wider layer was less than 20% of the thickness of the layer.

The interceptors for use in the present invention may have forms and wall thickness other than illustrated hereinbefore. For instance, the wall thickness of an interceptor as shown in FIG. 3, may be larger than 0.5 mm. It should be considered, however, that also over this wall there occurs bead formation on the boundary edge of the curtain liquid, and therefore said thickness should preferably not be much larger than some millimeters. The distance of 3 millimeters for the height of the wall 41 in the FIG. 5 embodiment should be considered as a practical upper limit.

An improved embodiment of the interceptor illustrated in FIGS. 3 and 4 is shown in FIG. 6. The interceptor 13 has generally the same form as that of FIGS. 3 and 4, but has been made from a relatively thick plate material in order to obtain a high dimensional stability that prevents deformation of the interceptor upon manipulation for adjustment, for cleaning, etc.

The end face 48 of the bottom wall 23 of the interceptor that faces the opposite interceptor, and that in fact forms the limit of interception of the curtain, has a slanting position which is such that a sharp edge 47 is formed. It has been shown that the free opening between this edge and the surface of the web caused a less thickened bead than did the end face of a bottom wall that was not bevelled, and that had a height of several millimeters.

It will be understood that the present invention is not limited to the described embodiments and examples, and we refer to the patent literature of the last decenniums wherein numerous examples of the coating of single and multi-layers in photography have been disclosed, and from which also other techniques than the one disclosed in U.S. Pat. No. 4,233,346 are known for multi-layer curtain coating wherein there occurs no intermixing of coating composition that is recirculated to the coating hopper.

Any suitable measures known in the art can be adopted if required to achieve satisfactory coating results for the purpose in view in any particular case. Examples of such measures are the use of air shields for removing air being carried along with the web and for reducing the air barrier which the free-falling curtain must penetrate, more sophisticated forms of edged guides, a vacuum manifold which is positioned adjacent the web to be coated to withdraw air from the web at the region of impact of the curtain, curtain guides that are easily adjustable to determine an optimum angle of convergence for obtaining a stable curtain, etc.

We claim:

1. In a method of curtain coating a flexible web, which method comprises conveying the web over a web-supporting roller; forming a free-falling curtain of coating composition of a width greater than that of the web, said width being maintained by side edge guides in wetting contact with the curtain edges, said curtain being so positioned that its central region falls on a roller-supported region of the web while the opposed side edges of the curtain extend externally of the opposed side boundaries of the web; and intercepting and collecting edge portions of the curtain which would otherwise impinge on margins of the web thereby to preserve those margins in uncoated condition, the improvement where the web-supporting roller has a length less than the width of the web and leaves opposite marginal portions of the web unsupported, and said curtain edge portions are intercepted in at least close proximity to the plane of the supported regions of the web at a locus where said marginal portions of the web are slightly downwardly deflected out of said plane against elastic recovery forces thereby induced in the web.

2. A method according to claim 1, wherein the flexible web passes around said web-supporting roller and the position of the curtain is such that its central region falls on the web at a zone within a part of the web path which is curved around such roller.

3. A method of curtain coating according to claim 1 wherein positive deflecting force is applied to at least the outer half of the width of the projecting unsupporting web margins.

4. A method according to claim 1, wherein the interceptors are mounted in a tilted position so that the intercepted liquid is drained off gravity.

5. A method according to claim 1, wherein the edge guides extend downwardly below the plane of the supported region of the web.

6. Method according to claim 1, wherein said curtain is a composite curtain that is composed of at least two distinct liquid layers that are in adherant contact with each other.

7. A curtain coater for coating a flexible web, which coater comprises means for conveying a web along a predetermined path through a coating station, said conveying means including a web-supporting roller at that station, said roller having an axial length less than the width of the web whereby at least one side margin of said web projects in unsupported fashion beyond the roller end; means for forming at said coating station a falling curtain of coating composition of a width exceeding the supported region of said web and falls onto the web at said coating station; side edge guides for contact by the side edges of a said curtain thereby to restrain the curtain from necking-in; and means for (a) contacting each such unsupported side margin of said web while passing through said coating station and deflecting against the elastic forces of the web said margin downwardly out of the general plane of the web at said station and for (b) intercepting at least proximate to said general web plane the corresponding end portion of said curtain to prevent the same from otherwise falling upon at least a terminal part of said unsupported web margin and conveying the thus-intercepted curtain composition away from the web margins.

8. A coater according to claim 7, wherein the conveying means is adapted to convey a flexible web around an arc of said web-supporting roller and said coating station is situated within said arc.

9. A curtain coater according to claim 7, wherein the intercepting means is of channel form.

10. A curtain coater according to claim 9, wherein the channels are inclined downwardly, so that the intercepted liquid is conveyed away under gravity.

11. A curtain coater according to claim 10, wherein said intercepting means has an inner edge and said inner edge is beveled upwardly at an acute angle whereby an intercepting edge is formed.

12. A curtain coater according to claim 7, wherein the intercepting means outside the web margin is penetrated by the corresponding curtain edge guide.

13. A curtain coater according to claim 7, wherein the roller length is such as to leave both opposite side margins of the web unsupported, said deflecting and intercepting means are provided for both of said opposite side web margins, said intercepting means include inner edges inside the limits of said web, and said inner edges diverge from one another in the direction of movement of the web along said path.

* * * * *